US007945374B2

(12) United States Patent
Keegan et al.

(10) Patent No.: US 7,945,374 B2
(45) Date of Patent: May 17, 2011

(54) METHOD AND APPARATUS FOR CHARACTERIZING FUEL INJECTOR PERFORMANCE TO REDUCE VARIABILITY IN FUEL INJECTION

(75) Inventors: Kevin R. Keegan, Hilton, NY (US); Ronald J. Krefta, Noblesville, IN (US)

(73) Assignee: Delphi Technologies, Inc., Troy, MI (US)

( * ) Notice: Subject to any disclaimer, the term of this patent is extended or adjusted under 35 U.S.C. 154(b) by 96 days.

(21) Appl. No.: 12/315,767

(22) Filed: Dec. 5, 2008

(65) Prior Publication Data

US 2010/0145597 A1 Jun. 10, 2010

(51) Int. Cl.
*F02D 41/30* (2006.01)

(52) U.S. Cl. ..... 701/106; 123/478

(58) Field of Classification Search ..... 701/102–104, 701/106, 114, 115; 123/299, 480, 446, 486; 73/114.45, 114.49, 114.52–114.54
See application file for complete search history.

(56) References Cited

U.S. PATENT DOCUMENTS

| | | | | |
|---|---|---|---|---|
| 5,241,858 | A | 9/1993 | Wieczorek et al. | |
| 5,392,995 | A | 2/1995 | Wahba | |
| 6,360,161 | B1 * | 3/2002 | Francis et al. | 701/115 |
| 6,588,398 | B1 * | 7/2003 | Rodier | 123/299 |
| 6,671,611 | B1 * | 12/2003 | Peltier | 701/104 |
| 6,775,607 | B2 * | 8/2004 | Koerner | 701/104 |
| 6,801,847 | B2 * | 10/2004 | Jaliwala et al. | 701/104 |
| 6,892,569 | B2 * | 5/2005 | Martin et al. | 73/114.45 |
| 7,004,150 | B2 * | 2/2006 | Augustin | 123/494 |
| 7,025,047 | B2 * | 4/2006 | Leman et al. | 123/486 |
| 7,136,743 | B2 * | 11/2006 | Peltier | 701/115 |
| 2003/0130784 | A1 * | 7/2003 | Peltier | 701/104 |
| 2004/0128055 | A1 * | 7/2004 | Jaliwala et al. | 701/104 |

* cited by examiner

*Primary Examiner* — Stephen K Cronin
*Assistant Examiner* — Johnny H Hoang
(74) *Attorney, Agent, or Firm* — Thomas N. Twomey

(57) ABSTRACT

A method for equalizing fuel injector flows among a plurality of fuel injectors in an internal combustion engine including the steps of a) characterizing the electrical and/or mechanical performance of each fuel injector; b) imprinting characterization data on each fuel injector; c) reading the imprinted data into a control computer, preferably at the time of engine assembly or sub-assembly; and d) using the characterization data in an algorithm to adjust at least one electrical parameter such as hold current, peak current, and boost time for each fuel injector in an assembled engine during each fuel injection cycle.

11 Claims, 5 Drawing Sheets

METHOD AND APPARATUS FOR CHARACTERIZING FUEL INJECTOR PERFORMANCE TO REDUCE VARIABILITY IN FUEL INJECTION

TECHNICAL FIELD

The present invention relates to fuel injectors for internal combustion engines; more particularly, to an inherent variation in the performance within a group of individual fuel injectors; and most particularly, to a method and apparatus for reducing such performance variations among a plurality of standard fuel injectors assembled into a multiple-cylinder engine by measuring each fuel injector prior to installation and providing the individual calibration information to an engine control module.

BACKGROUND OF THE INVENTION

Direct Injection Gasoline (DIG) fuel injection in an internal combustion engine involves injection of fuel directly into each combustion chamber. A high range of fuel flows is required to meet engine power demands ranging from very low idle speed to peak power.

It is known in the art that a variation in net hold force (force required of an injector solenoid to hold the valve open against closing spring force and fuel pressure) at a specific applied current is responsible for a large portion of the variation among fuel injectors in closing response and therefore in flow and linear range variation. The variation in hold force is associated with several dimensions, and also with batch-to-batch magnetic characteristic variation in materials of construction, and also with mechanical tolerances caused by machining of individual components.

It is known in the diesel engine arts to determine flow characteristics of each fuel injector at a fixed hold current and to program this information into the Engine Control Module (ECM) at the time of engine assembly, allowing the ECM to compensate at least partially for variations in flow differences among the injectors in an engine by varying instructions to the individual injectors.

This approach, however, does not address the more fundamental problem of variation in performance with variations in mechanical and magnetic properties and does not provide sufficient correction for a DIG engine. Further, it is desirable that a specified hold current (expressed by the ECM as an applied voltage) be great enough to assure that the injector valve stays fully open for the desired period but not so great as to delay closing of the valve due to extended hysteresis in collapse of a larger-than-necessary magnetic field.

This problem is addressed by at least two US patents.

U.S. Pat. No. 5,241,858 is directed to a dynamic flow calibration of a fuel injector by selective diversion of magnetic flux from the working gap. The fuel injector has a dynamic flow calibration mechanism in which a control rod that extends between and enters holes in both the stator and the armature is selectively positioned to divert some of the magnetic flux from the axial working gap between the stator and the armature such that the diverted magnetic flux passes through the control rod directly between the stator and the armature without passing through the working gap. The fuel injector is calibrated by selectively positioning the control rod so that the diverted flux which is conducted between the stator and the armature is conducted through the control rod without passing through the working gap.

U.S. Pat. No. 5,392,995 similarly is directed to a fuel injector calibration through directed leakage flux. The solenoid includes a tubular pole piece with an area of increased reluctance adjacent the working surface of the pole piece and an adjustment rod disposed for movement within the high reluctance region to thereby vary the location at which the high reluctance region begins. Leakage flux from the high reluctance region of the magnetic circuit may be directed to operate on a particular element of the magnetic circuit based on the location of the adjustment rod thereby allowing the leakage flux to exert a force on the element and to thereby vary the dynamic response characteristics of the injector.

Neither of these inventions addresses the problem of an injector having a specified and fixed hold current that is inadequate for reliably keeping the injector valve fully open for the desired length of time under all operating conditions.

Further, both of these inventions require very substantial modifications to a standard fuel injector, including an expensive and cumbersome moveable rod and rod-positioning mechanism.

What is needed in the art is a method for providing to an ECM a characterization of the electrical and mechanical properties of each fuel injector in an internal combustion engine, such that the ECM can vary, via an algorithm, one or more electrical parameters for each injector to equalize the fuel injection characteristics of all the injectors in the engine. The method should be readily applicable to standard prior art fuel injectors and not require special modifications to the fuel injectors.

It is a principal object of the present invention to equalize the fuel flows among a plurality of standard fuel injectors in an internal combustion engine.

SUMMARY OF THE INVENTION

Briefly described, a method for equalizing fuel injector flows among a plurality of fuel injectors in an internal combustion engine includes the steps of:

a) characterizing the electrical and/or mechanical performance of each fuel injector as a function of at least one of coil resistance, transient magnetic flux linkage response, and pintle closing response;
b) imprinting characterization data or a pointer thereto on each fuel injector;
c) reading the imprinted data into a control computer, preferably at the time of engine assembly or sub-assembly; and
d) using the characterization data in an algorithm to adjust at least one electrical parameter for each fuel injector in an assembled engine during each fuel injection cycle.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
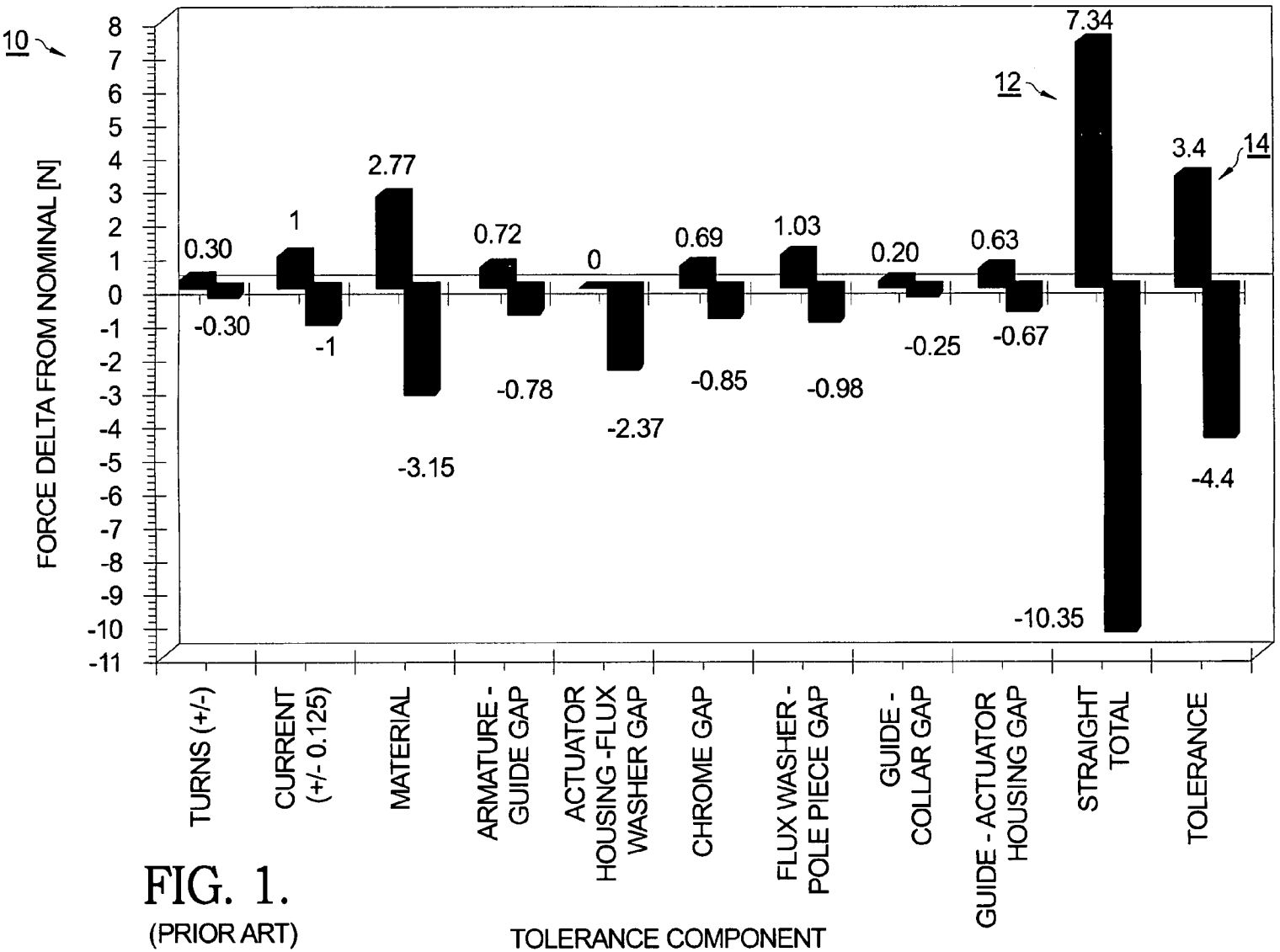
FIG. 1. (PRIOR ART)
FIG. 1 is a histogram showing relative contributions to variation in hold force for prior art fuel injectors.

Referring to FIG. 1, histogram 10 shows the contributions of various materials and manufacturing tolerances to the deviation in force from nominal for a standard prior art DIG fuel injector. It is seen that the total spread 12 of all deviations is nearly 18 N (+7.34 N to −10.35 N); the corresponding tolerance spread 14 of RMS values is nearly 8 N (+3.4 N to −4.4). This range of variation in fuel injector opening force is too great to meet the need for cylinder-to-cylinder uniformity in fuel flow in modern engines in which a fixed nominal hold current is supplied to all fuel injector solenoids. Hence, the need for the present invention wherein the supplied hold current (actually supplied voltage) is selected to meet the electromechanical characteristics of each individual fuel injector.

A critical factor in solenoid performance is the solenoid's flux linkage, which can be found from terminal voltage and current, the voltage being a function of the current (I) and resistance (R) plus the rate of change of magnetic flux linkage (λ):

$$V=IR+d\lambda/dt \quad \text{(Eq. 1)}$$

Rearranging, flux linkage is found by integrating voltage over time:

$$\Lambda=\int_0(V-IR)dt \quad \text{(Eq. 2)}$$

The force F exerted by the solenoid and the flux linkage λ are related by the equation:

$$F=(k_1\lambda^2)/A \quad \text{(Eq. 3)}$$

where k is a parameter based on the ratio of magnetizing to total flux and the coil turns, and A is the cross-sectional area of the airgap.

Figure 2:
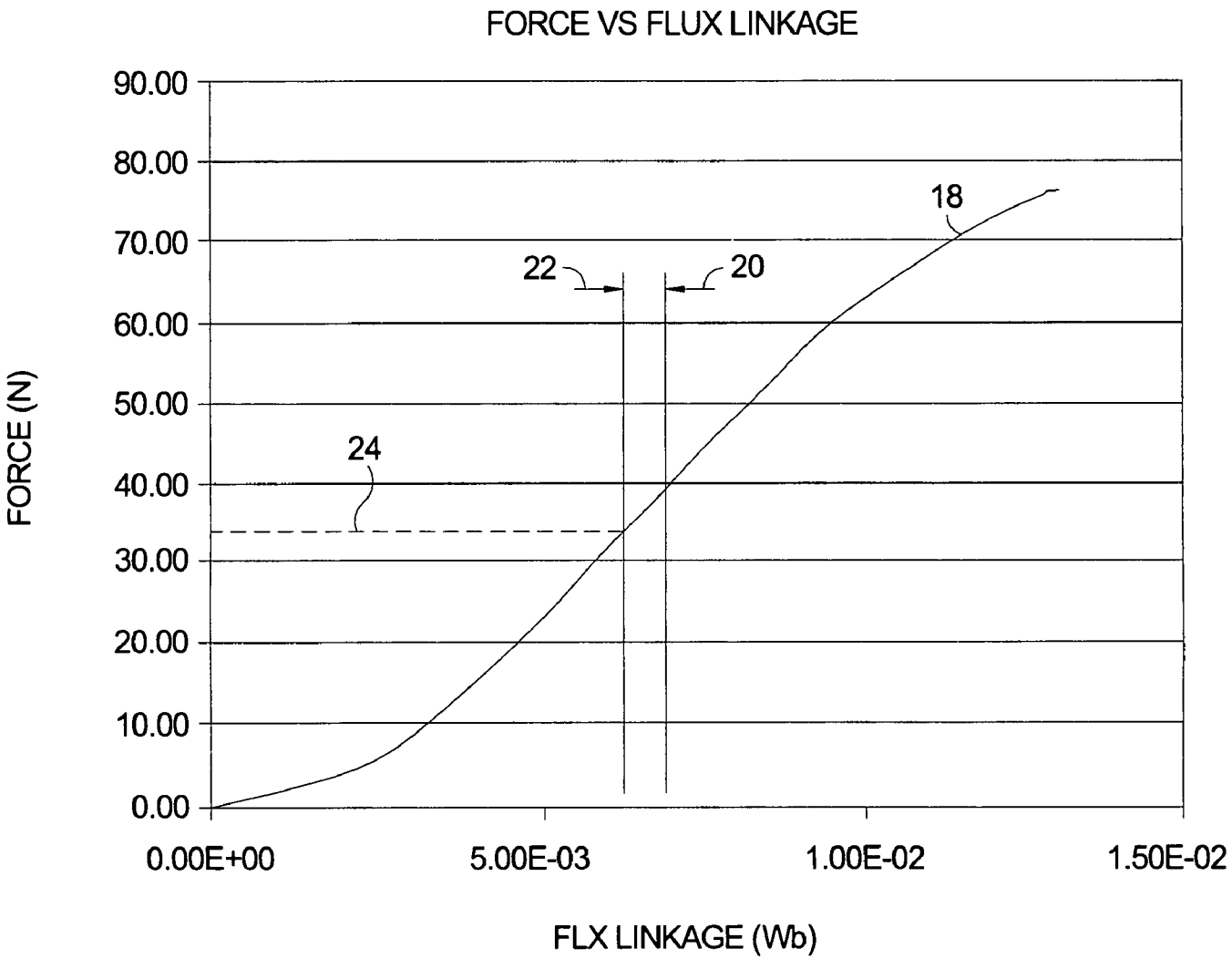
FIG. 2 is a graph of injector solenoid force as a function of flux linkage, showing adjustment in force in accordance with the present invention.

This relationship is shown graphically in FIG. 2, as is also the basis for the invention, wherein force F 18 is shown as a function of flux linkage λ. If the desired or nominal solenoid holding force F is, for example, 40 N, an aim flux linkage 20 is required in response to a standard test current C (not shown). However, if the measured flux linkage 22 of a tested fuel injector is less than aim 20, then the force F of which the solenoid is capable of holding at that current is proportionally less 24 (in the exemplary case shown, F is about 34 N).

Since force F is directly related to the current C applied to a solenoid, it will be seen that the application of higher current to a given sub-standard fuel injector can increase the applied force, within reasonable limits.

Figure 3:
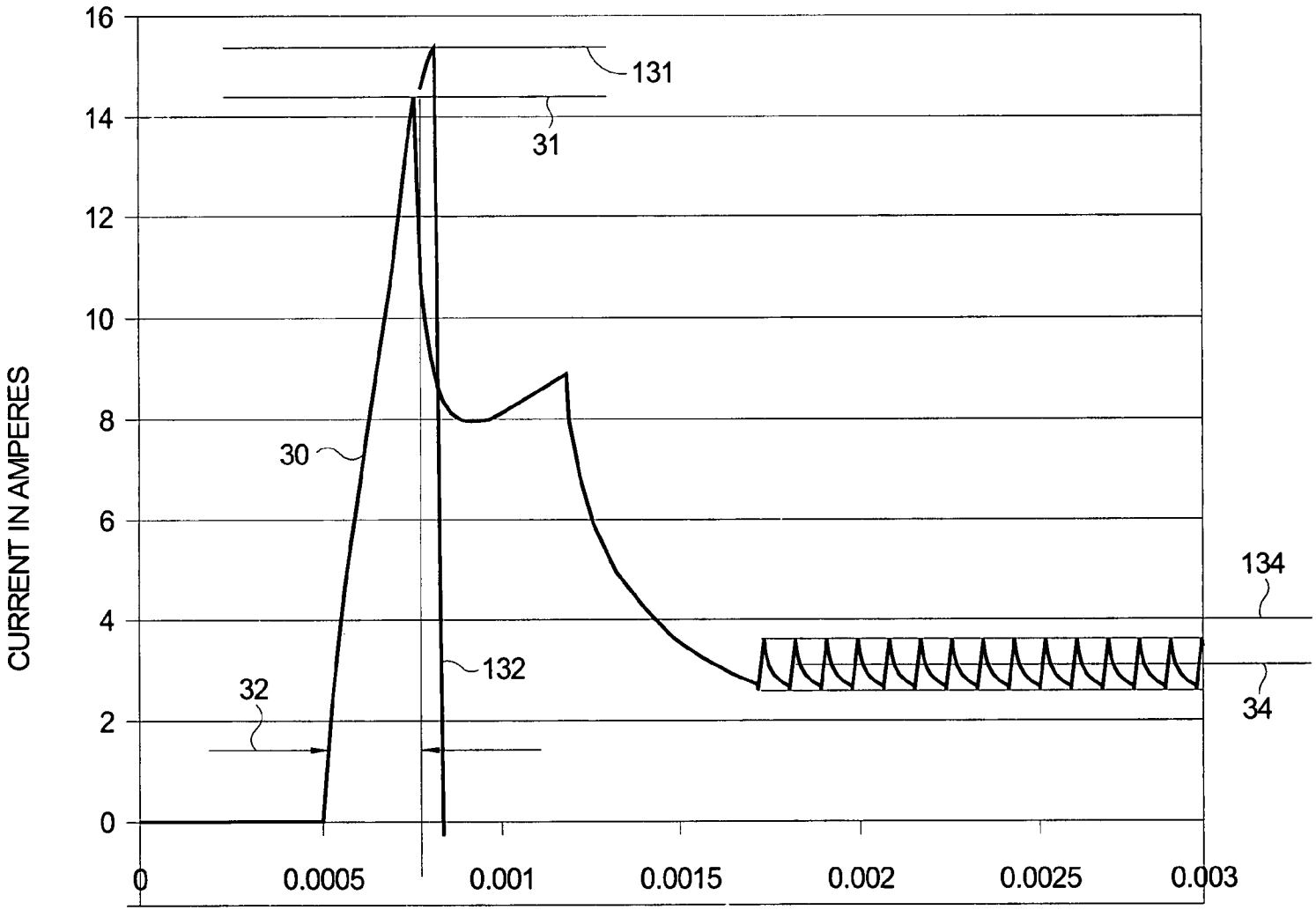
FIG. 3 is a graph of applied current as a function of time during a fuel injector operating cycle, showing adjustment of peak current/time and hold current in accordance with the present invention.

Referring to FIG. 3, a graph is shown of current C in amperes during a 5 performance cycle of a prior art fuel injector. An exemplary curve 30 could be representative of the sub-standard fuel injector yielding a holding force F=34 N in FIG. 2. Curve 30 shows a rapid increase in current to about 14.5 amperes 31 during a "boost" time period 32 wherein a high current (actually a high voltage, causing a proportionally high current) is applied to open the fuel injector valve as rapidly as possible. At the end of time period 32, the current is reduced to a nominal hold current level 34 of about 3.0 amperes and is hysteretically controlled about that level to provide a hold force on the fuel injector valve during the principal fuel injection period.

In the present example, it is found from experience that 3.0 amperes does not provide a hold force sufficient to guarantee that the fuel injector valve stays fully open for the required period of injection, and that an increase in hold current 34 to a higher current 134 of about 4.0 amperes is required for this injector to meet the hold force aim. This requirement of 4.0 amperes is printed in code, such as in a bar code or square code, on the body of the injector itself, for use subsequently as described below. Thus, a prior art sub-standard fuel injector having a characteristically lower holding force can be suitably energized in accordance with the present invention to provide an adequate hold force.

In addition, the peak opening current 31 may be increased by increasing the boost current itself to a higher peak level 131 and/or by extending 132 the boost time period. Preferably the increase in boost current is by the same percent as the hold current increase.

The target hold current for each injector may be determined in at least any of several methods contemplated by the invention, as follows:

1. Measure directly the specific injector hold force required at flow time, e.g., by lowering hold current until the valve closes (pintle closing response), then add some margin to this measured "pull-out" force to set the target hold force and target hold current.

2. Determine the target hold force (and subsequent current) by measuring the injector flux linkage as described above.

3. Two measurements may be used to determine the appropriate driver (current) calibration values. These include a mechanical measurement (such as a pop-off pressure, dynamic flow, or release current) in concert with an electrical measurement (such as the flux linkage measurement or coil resistance measurement). Such a test provides additional information to set the injector to the optimum hold current level, providing information on not only the resultant magnetic force as described above but also the net force developed, allowing for the calculation of the mechanical load force, including hydraulic force, spring force, and friction. With such information, the target hold current and/or the spring force can be calibrated to provide for better injector performance and further reduced variation.

Figure 4:
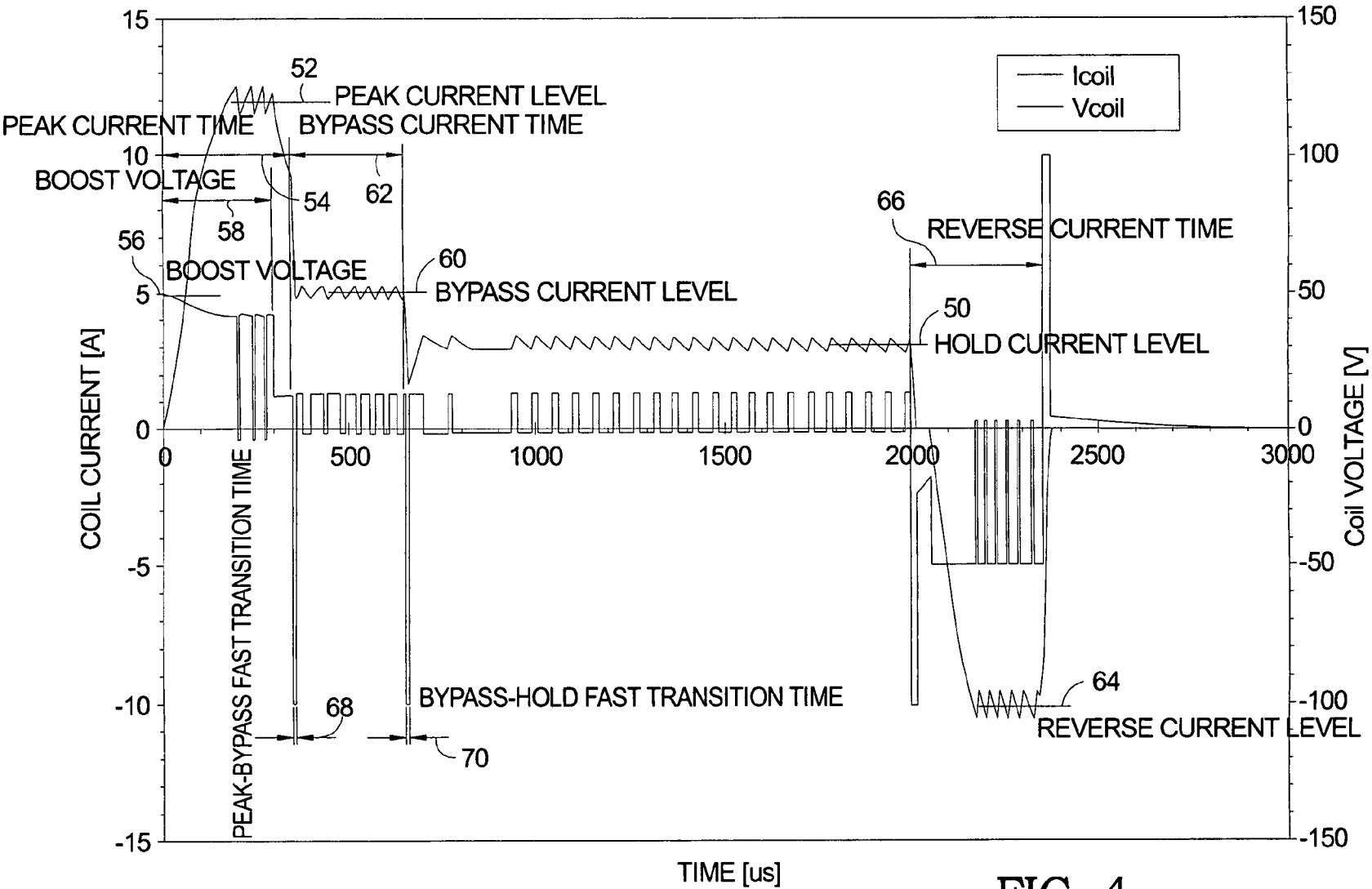
FIG. 4 is a graph of applied voltage and current during a performance cycle of an injector defining a variety of driver parameters that may be employed and calibration constants assigned to the injector, in accordance with the invention.

The flux linkage data may be used further to provide information to calibrate other driver parameters in addition to the hold current parameter. From the rate of change of the flux linkage, which may vary due to material and geometry tolerances and the peak and hold flux linkages observed in a pulse, driver parameters such as, for example, hold current (50), peak current (52), peak current time (54), boost voltage level (56), boost time (58), bypass current level (60), bypass current time (62), reverse current level (64), reverse current time (66) and fast transition time (peak bypass (68) and bypass hold (70)), may be adjusted to meet a specified transient flux linkage profile. These parameters are graphically defined in FIG. 4 of a plot made of applied voltage and current during a performance cycle of a typical fuel injector. These driver parameters would be calibration constants assigned to the injector as noted above, coded onto the injector body, and loaded into the ECM.

Figure 5:
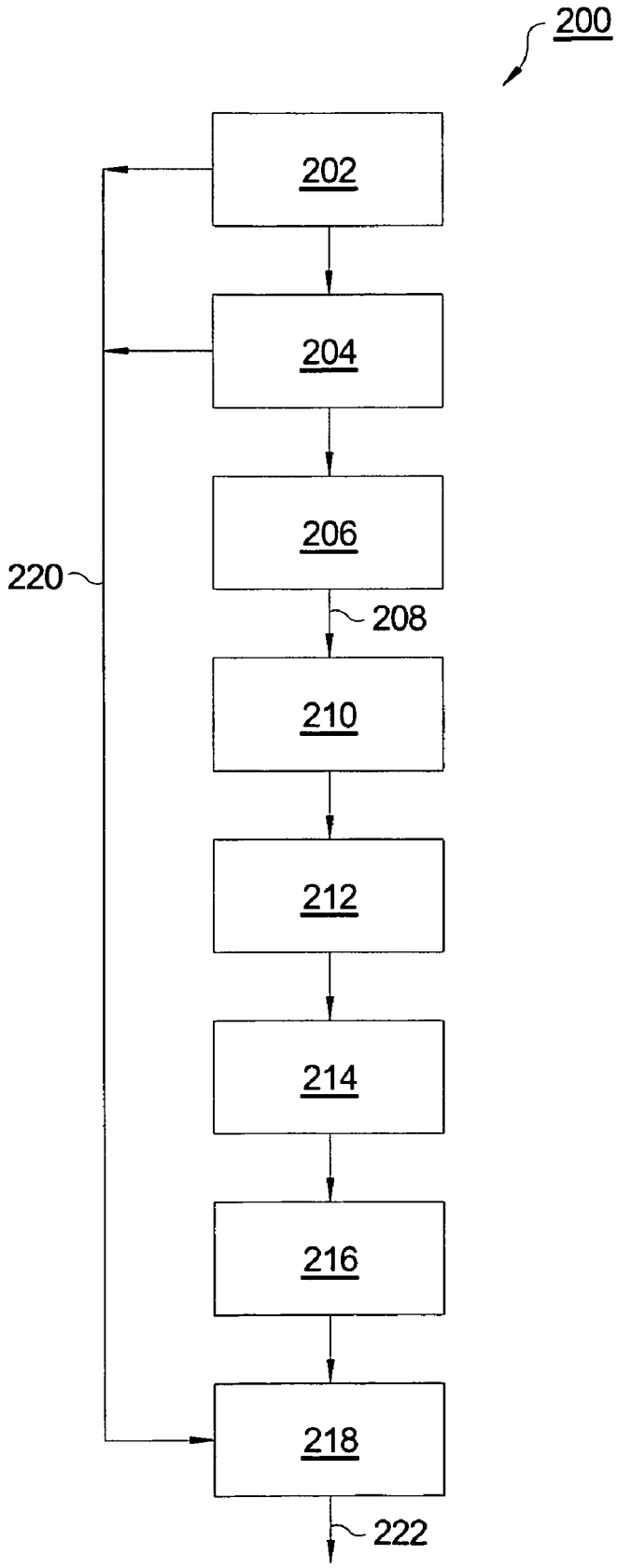
FIG. 5 is a schematic diagram of a process for adjusting a fuel injector's wave form and operating cycle in accordance with the present invention.

Referring now to FIG. 5, an exemplary method 200 in accordance with the present invention is shown schematically for equalizing fuel injector flows among a plurality of fuel injectors in an internal combustion engine. The flow path shown is for an exemplary fuel injector in a family of fuel injectors.

The following steps may be included in method 200:

1. Measurement 202: The electrical and/or mechanical performance characteristics of the fuel injector are measured as described above.

2. Storage of Codes 204: The performance characteristics measured in 202 are stored as by printing in code including individual fuel injector identification on the injector body and the fuel injector is transported to an engine assembly facility. Alternatively, the characteristics may be read directly into a computer file, and only identification printed on the fuel injector.

3. Assembly on Engines 206: The fuel injector is assembled into an engine 208, along with the appropriate number of other fuel injectors.

4. Reading of Code 210: The fuel injector identification and characteristics data, if not already filed as in Step 2, are read and entered into a computer file.

5. Temporary storage 212: The assembled engine is sent to in-process storage.

6. Assembly on Vehicle 214: The engine is assembled into a vehicle during vehicle assembly.

7. ECM Assembly on Vehicle 216: The Engine Control Module is assembled into the vehicle during vehicle assembly and is connected to the fuel injectors.

8. Download on ECM 218: The electromechanical performance characteristics are retrieved from the computer file and downloaded into the ECM in the vehicle; obviously, such download may occur prior to installation of the ECM as desired.

In simplest form 220, the method includes steps 202, 204, and 218.

The engine is now ready for using 222 the characterization data in an algorithm to adjust one or more parameters such as hold current, peak current, peak current time, boost voltage level, boost time, bypass current level, bypass current time, reverse current level, reverse current time and fast transition time for each fuel injector during each fuel injection cycle.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for equalizing fuel injector flows among a plurality of fuel injectors in an internal combustion engine, comprising the steps of:

a) determining characterization data based on a performance of an at least one fuel injector prior to installing the at least one fuel injector into the internal combustion engine; and b) using said characterization data to program at least one electrical parameter of said at least one fuel injector into an engine control module configured to control the internal combustion engine when the at least one fuel injector is installed into the internal combustion engine, wherein said at least one electrical parameter is selected from the group consisting of hold current, peak current, peak current time, boost voltage, boost time, bypass current level, bypass current time, reverse current level, reverse current time and fast transition time.

2. A method in accordance with claim 1 wherein said performance from which characterization data is determined is mechanical performance of the fuel injector.

3. A method in accordance with claim 1 wherein said performance from which characterization data is determined is electrical performance of the fuel injector.

4. A method in accordance with claim 1 wherein said performance from which characterization data is determined is both mechanical performance and electrical of the fuel injector.

5. A method in accordance with claim 2 wherein said mechanical performance of the fuel injector is selected from the group consisting of pop-off pressure and dynamic flow.

6. A method in accordance with claim 3 wherein said electrical performance of the fuel injector is selected from the group consisting of flux linkage measurement and coil resistance measurement.

7. A method in accordance with claim 1 wherein said engine is selected from the group consisting of spark-ignited and compression-ignited.

8. A method in accordance with claim 1 wherein said plurality of fuel injectors are direct injection fuel injectors.

9. A method in accordance with claim 1 comprising the further steps of: a) imprinting said characterization data on said at least one fuel injector; and b) reading said imprinted characterization data into the engine control module to program the engine control module with the characterization data imprinted on said at least one fuel injector.

10. A method in accordance with claim 9 wherein said reading step is carried out at a time selected from the group of engine sub-assembly, engine assembly, and vehicle assembly.

11. An internal combustion engine comprising a plurality of direct injection fuel injectors controlled by an engine control module, wherein at least one of said plurality of fuel injectors is characterized for at least one of electrical and mechanical performance prior to connecting the at least one of said plurality of direct injection fuel injectors to the engine control module, wherein said engine control module is programmed with data representing said characterization when the at least one of said plurality of fuel injectors is connected to the engine control module, wherein said engine control module controls said fuel injectors in accordance with at least one algorithm employing said data to determine at least one electrical parameter, and wherein said at least one electrical parameter is selected from the group consisting of hold current, peak current, peak current time, boost voltage, boost time, bypass current level, bypass current time, reverse current level, reverse current time and fast transition time.

* * * * *